US006804830B2

(12) United States Patent
Reynolds et al.

(10) Patent No.: US 6,804,830 B2
(45) Date of Patent: Oct. 19, 2004

(54) FULL BODY HARNESS FOR FALL ARREST

(75) Inventors: Richard G. Reynolds, Alvada, CO (US); Joseph P. Feldstein, Littleton, CO (US)

(73) Assignee: Mine Safety Appliances Company, Pittsburgh, PA (US)

( * ) Notice: Subject to any disclaimer, the term of this patent is extended or adjusted under 35 U.S.C. 154(b) by 0 days.

(21) Appl. No.: 10/677,018

(22) Filed: Oct. 1, 2003

(65) Prior Publication Data

US 2004/0065272 A1 Apr. 8, 2004

Related U.S. Application Data

(60) Provisional application No. 60/416,060, filed on Oct. 4, 2002.

(51) Int. Cl.[7] ..... A41D 13/00
(52) U.S. Cl. ..... 2/69; 182/3
(58) Field of Search ..... 2/69, 102, 94, 2/79, 85, 93, 300, 311, 312; 119/770; 128/846, 874, 875; 182/3, 4; 244/151 R

(56) References Cited

U.S. PATENT DOCUMENTS 4,712,513 A * 12/1987 Huppertsberg ..... 182/3
5,203,829 A * 4/1993 Fisk et al. ..... 119/857
5,329,884 A * 7/1994 Bell ..... 119/857
5,433,289 A * 7/1995 O'Rourke ..... 182/3
5,607,258 A 3/1997 Eungard
5,957,091 A * 9/1999 McDonald et al. ..... 119/770
5,960,480 A * 10/1999 Neustater et al. ..... 2/456
6,253,874 B1 7/2001 Wolner
RE37,394 E * 10/2001 Woodyard ..... 2/102
6,378,465 B1 4/2002 Austin

FOREIGN PATENT DOCUMENTS

EP 0 807 451 A 11/1997
GB 991 230 A 5/1965

* cited by examiner

*Primary Examiner*—Tejash Patel
(74) *Attorney, Agent, or Firm*—James G. Uber

(57) ABSTRACT

The present invention provides a full body harness which can include curved webbing, a spreading back pad and/or leg buckles which improve the comfort, use and performance of the harness. Preferably, the harness uses five pieces of webbing, namely, two curved webbing shoulder straps, two identical leg straps, and a subpelvic strap. The harness can also have a spreading back pad which helps to keep the shoulder straps from riding up onto the neck of the wearer.

20 Claims, 4 Drawing Sheets

FULL BODY HARNESS FOR FALL ARREST

This application claims the benefit of Provisional Application No. 60/416,060, filed Oct. 4, 2002.

FIELD OF THE INVENTION

The present invention relates to a primary component of a personal fall arrest system, namely, the harness. The harness, often called a full body harness, is designed to safely support a person being lifted or lowered as well as to sufficiently distribute the fall arrest forces across the wearer's body, thereby reducing injury from a fall if the harness is properly used as part of a fall arrest system.

BACKGROUND OF THE INVENTION

Full body harnesses are widely used for lifting and lowering individuals in dangerous situations and as a primary component in a personal fall arrest system. They can also be used for work positioning, travel restriction, ladder climbing, rescue retrieval and evacuation. While these harnesses are used mainly in an industrial setting, and particularly the construction industry where the likelihood and danger of falls from heights is both numerous and significant, a full body harness can be used in various other applications in which total suspension and support of the body must be ensured, either expectedly or unexpectedly.

Various full body harnesses are shown on pages 6–19 of the MSA *Fall Protection Catalog* [Vol. 4-2001/2002], including the FP Pro™ Harness, FP Trades™ Harness, FP Rescue™ Harness and FP Classic™ Harness. Such harnesses typically include adjustable shoulder straps which can be guided in a crossed fashion through a generally rectangular shaped pad formed on a rear part of the harness which is worn on a person's back and is often called a rear pad or back pad. Generally, the shoulder straps are made from pieces of straight webbing.

In the FP Pro Harness, as described in U.S. Pat. No. 5,957,091, the shoulder straps made from straight webbing continue forwardly over the shoulders and adjustably attach to each other via a pair of metal hip plates. Two leg straps are also adjustably attached to the hip plates and wrap around the legs of the wearer. The leg straps are also made from pieces of straight webbing.

The FP Classic™ Pullover® Harness is more particularly shown and described in U.S. Pat. No. 4,712,513. This harness does not require the pre-adjustment of numerous elements to a particular individual but can be adjusted simply and quickly with a single adjustment for practically all sizes of individuals for whom the harness is intended. However, it also uses only pieces of straight webbing.

While all of the above-mentioned harnesses meet the applicable safety requirements, it would be desirable to improve their comfort without reducing the quality and versatility of these harnesses.

SUMMARY OF THE INVENTION

Generally, the present invention is a full body harness which utilizes pieces of curved webbing. Preferably, the harness comprises: a pair of shoulder straps (preferably adjustable) comprising curved webbing; a subpelvic strap; a pair of leg straps (preferably adjustable); a back pad; a shoulder strap retainer (preferably a front pad or a chest strap); and a pair of leg buckles. While the curved webbing is preferably utilized in the shoulder straps, it could also be utilized in other parts of the harness such as the leg straps or the subpelvic strap.

The present invention provides a unique, versatile and lightweight full body harness which still meets or exceeds most applicable requirements, including ANSI Z359.1, ANSI A10.14, CSA Z359.10 and OSHA, while improving its comfort. The full body harness of the present invention is uniquely designed to contain the torso of a wearer, position it in an upright position and distribute fall arrest forces to the thighs, chest and shoulders of the wearer in the event of a fall. The harness of the present invention is intended to be used in personnel fall arrest systems as well as in work positioning. The harness preferably comes in the Pullover® model and the Vest-Type™ model with several sizes in each model, including extra small, standard, and extra large. Additionally, the full body harness of the present invention provides improved comfort, for example, by preventing the shoulder straps from riding up onto the neck of the wearer.

The full body harness of the present invention preferably utilizes five pieces of webbing, namely, two shoulder straps, two leg straps and a subpelvic strap. Preferably, the shoulder straps of the harness comprise curved webbing. Preferably, the pieces of curved webbing are preformed into a slightly curved shape to provide enhanced wear relief from the webbing when worn in sensitive areas. The present invention can also include an improved back pad, a standard shoulder strap retainer such as a front pad or a chest strap, and a pair of leg buckles. The improved back pad preferably has a generally X-shaped design (with the upper arms of the X being longer than the lower arms which helps keep the shoulder straps from riding up onto the neck of the wearer. Each leg buckle is designed to facilitate quick connection and disconnection without permitting accidental disconnection.

Preferably, the safety harness of the present invention utilizes curved webbing in places where narrow webbing is used or in sensitive places such as the user's neck, torso, waist, groin or buttocks. The curved webbing provides enhanced wearer relief from webbing located in or near sensitive areas, when under low tension, without reducing the high tension performance of the webbing. For example, using curved webbing to form the shoulder straps prevents them from riding up onto the neck of the wearer.

The curved webbing can be formed by various methods that cause a distortion in the linearity of the webbing when under low tension. Such methods can include the use of elastic or crimped stuffer yarns, calendering, as well as special weaving. Another method used to obtain the curved webbing is to apply a heatset to the straight webbing. By applying heat, a shape can be formed in the webbing that creates the desired curvature.

Heatsetting is the preferred method of creating the curved webbing used in the harness of the present invention since it requires only one size of webbing from the mill/factory for use in all sizes of the harnesses. The straight webbing is placed into a preformed mold or channel of a heatsetting machine that has the desired shape or curve for the finished webbing. The machine applies heat (preferably dry heat) to the webbing until it is just below its melting temperature. For certain polyester webbing, this is around 470° F. For other materials, the temperature will be different. The webbing is held in the preformed channel that contains the desired curvature. As the webbing nears the melting point, it takes on the shape or curvature of the channel in which it is held. After the webbing is heated and takes on the desired curved shape, the webbing is cooled while still being retained in the channel or mold. After cooling, the curved webbing has the same feel as the non-curved webbing. Applicants have found that the heating/shaping process does not adversely affect the strength of the webbing or how the webbing performs in a dynamic fall.

The present invention also comprises an improved back pad that spreads the shoulder straps away from the neck area of the wearer by aiming the straps away from the center of the body. The spreading back pad of the present invention achieves this result through the location of the slots at the top of the back pad relative to the slots at the bottom of the back pad. Preferably, the slots at the top of the back pad are slightly offset upwardly and outwardly from the centerlines of the back pad relative to the slots at the bottom of the back pad thereby forming a generally Y-shaped configuration. Alternatively, this configuration may be described as generally X-shaped with the upper arms of the X being longer than the lower arms.

Other details and advantages of the present invention will become apparent as the following description of the invention proceeds.

BRIEF DESCRIPTION OF THE DRAWINGS

In the accompanying drawings, preferred embodiments of the present invention and preferred methods of practicing the present invention are illustrated in which.

PRESENTLY PREFERRED EMBODIMENT

Figure 2:
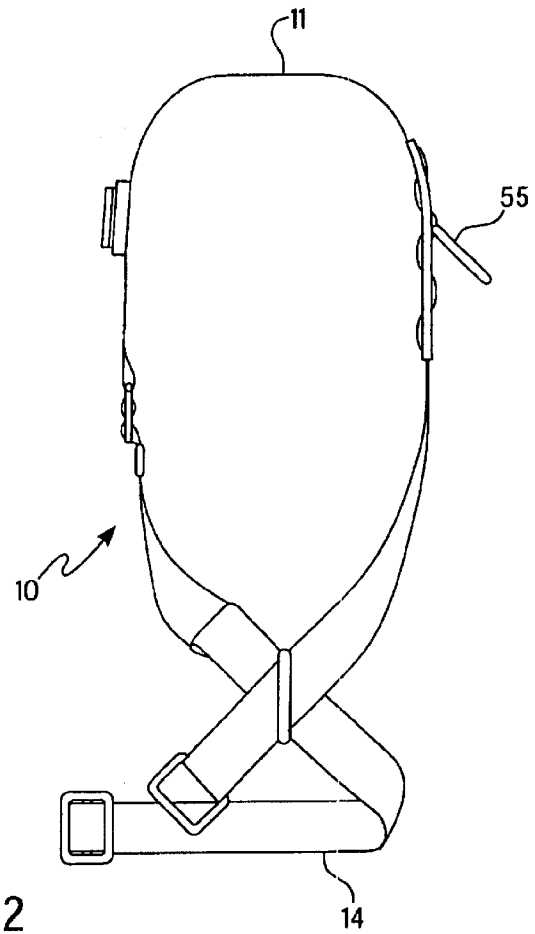
FIG. 2 is a side view of the full body harness shown in FIG. 1.
Figure 1:
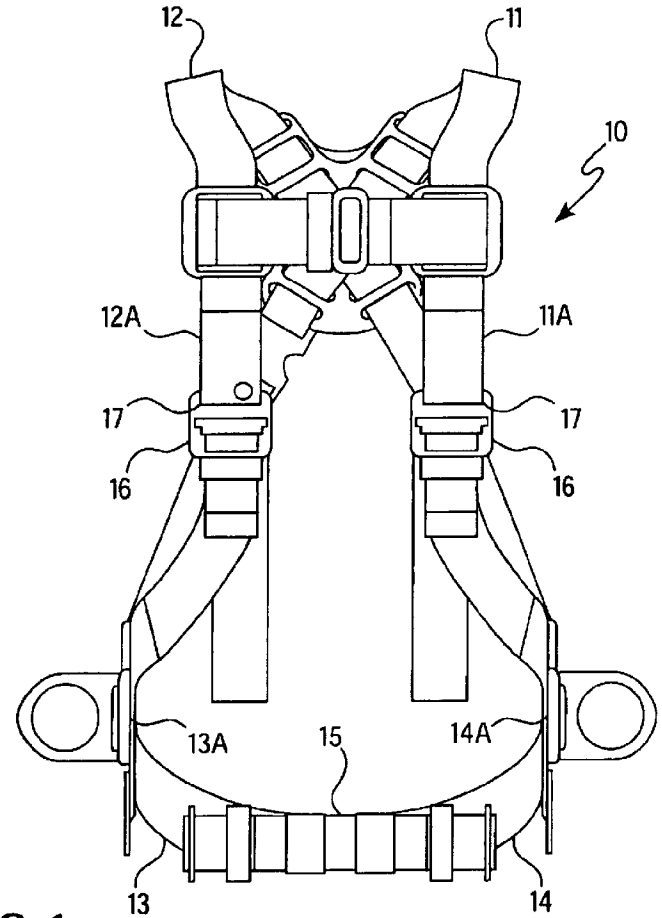
FIG. 1 is a front view of one embodiment of the full body harness of the present invention as it would be worn by a user.

FIGS. 1–2 show a Vest-Type™ version of harness 10 of the present invention. Preferably, there are two curved shoulder straps 11,12 (preferably mirror images of each other), two leg straps 13,14 (preferably identical), and a subpelvic strap 15. Each shoulder strap 11(12) is attached at one end 11A(12A) to an adjustment mechanism 16. Preferably, this attachment is a permanent connection made by passing end 11A(12A) of shoulder strap 11 (12) through a first slot 17 in adjustment mechanism 16, and sewing the end to the shoulder strap 11A(12A) to form a closed loop. Leg strap 13 (14) is attached at one point 13A (14A) to shoulder strap 11 (12). Preferably that attachment is a permanent connection made by sewing.

Figure 4:
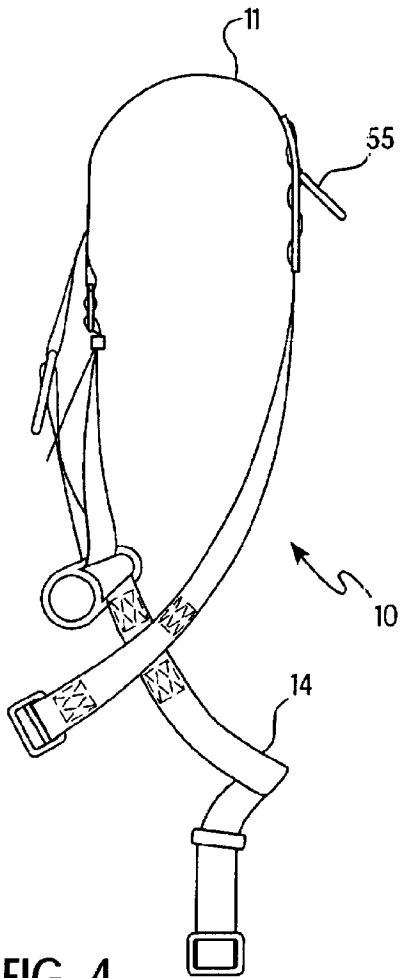
FIG. 4 is a side view of the full body harness shown in FIG. 3.
Figure 3:
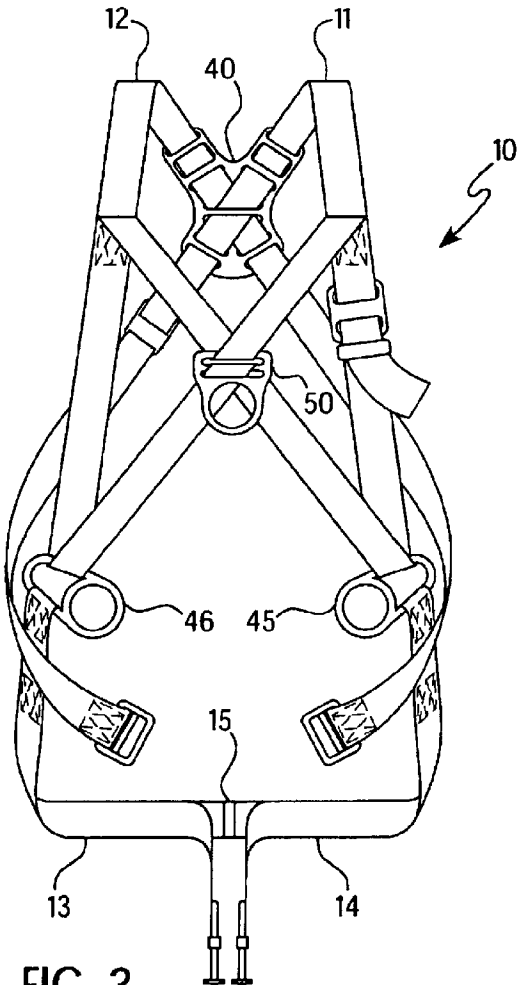
FIG. 3 is a front view of another embodiment of the full body harness of the present invention as it would be worn by a user.

FIGS. 3–4 show a Pullover® version of the harness 10 of the present invention. This version is very similar to the one shown in FIGS. 1–2, except that shoulder strap 11(12) proceeds upwardly across the wearer's back and through the spreading back pad 40 (preferably in a crossed manner) forwardly over the wearer's shoulders and then straight down over the wearer's chest to a loop 45(46) on the wearer's hip, then back up across the wearer's chest through front pad 50 to end and be attached to the other shoulder strap 12(11).

Figure 5:
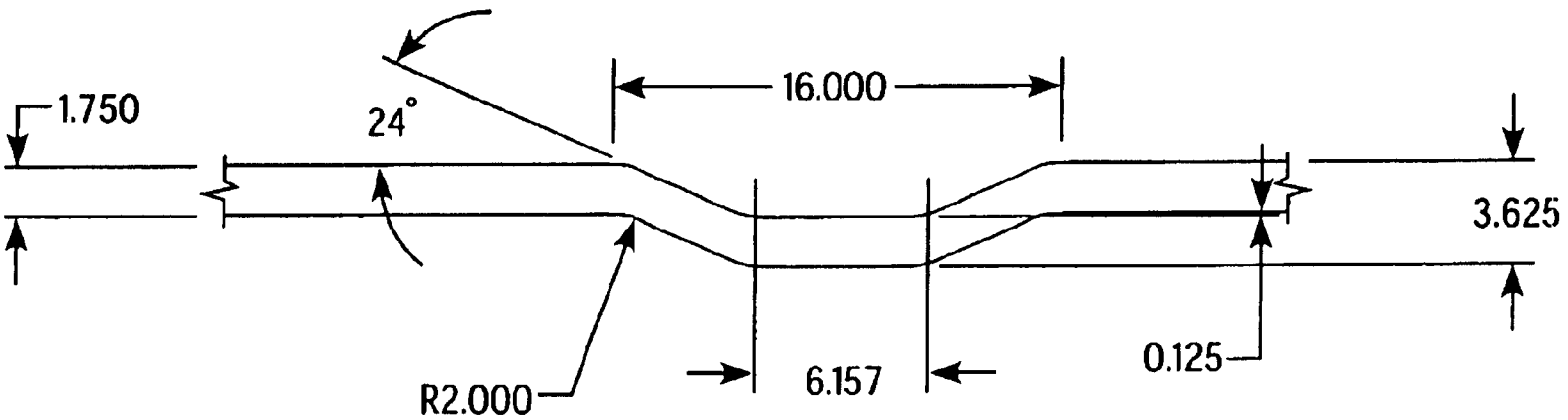
FIG. 5 shows a section of curved webbing used in a harness of the present invention.

FIG. 5 shows a preferred embodiment of the curved webbing used to form the shoulder straps of the present invention. Preferably, the webbing is a polyester material having a width of 1.75–2.0 inches, although other materials, such as nylon and Kevlar, as well as other sizes, will work. Preferably a U or C shaped curve is made in a 16-inch section of shoulder straps 11(12). The radius of curvature is two inches and occurs at an angle of 24°. The center portion of the curved webbing is actually a straight section of about six inches which is offset by about one webbing width from the noncurved (or straight) portion of the webbing.

Figure 6:
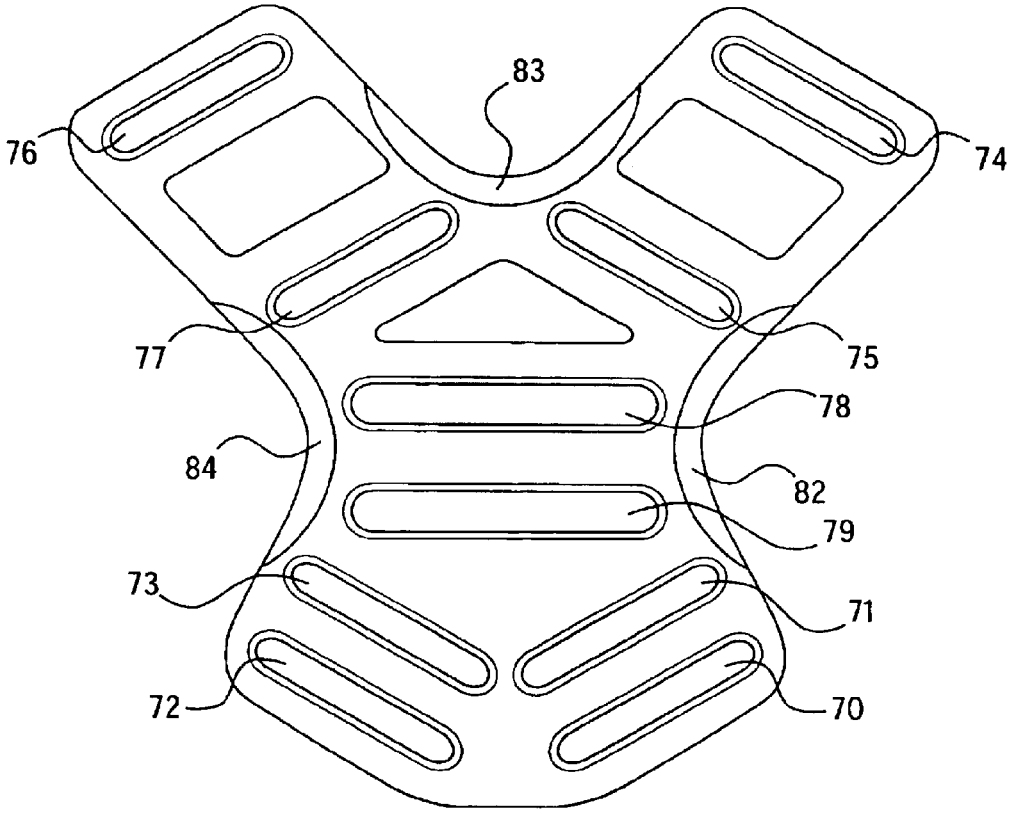
FIG. 6 is a top view of the spreading back pad that can be used in the full body harness of the present invention.

A preferred embodiment of the spreading back pad used in the harness of the present invention is shown in FIG. 6. The spreading back pad can be made from plastic and is generally Y-shaped with the openings at the top spaced farther away from the centerlines than the openings at the bottom of the Y. Alternatively, the spreading back pad can be generally X-shaped with the upper arms of the X being longer than the lower arms of the X. While the number of openings and the arrangement of the openings in the spreading back pad may vary, there should be enough openings to conveniently and adjustably attach each shoulder strap to the back pad as well as to attach D-ring 55. The harness also preferably includes a D-ring 55 which is attached to back pad 40 by should straps 11 (12) and serves as a connection point between harness 10 and a personal fall arrest system.

Preferably there are two slots in each leg of the X-shaped spreading back pad. Preferably, the slots 70,71 and 72,73 in the lower legs of the X-shaped spreading back pad are spaced between ½" and 1" apart and more preferably, ¾" apart as measured from centerline to centerline of the slots. Preferably, the slots 74,75 and 76,77 in the upper legs of the X-shaped spreading back pad are spaced between 1" and 3" apart and more preferably, 2" apart as measured from centerline to centerline of the slots. Preferably there are two additional slots 78,79, one on each side of the horizontal centerline of the spreading back pad through which the shoulder straps pass to attached D-ring 55. Additionally, the edges at the sides and top of the spreading back pad are slightly thicker to reinforce areas 82,83,84 of the spreading back pad and prevent cracking.

Although the present invention has been described in detail above for the purpose of illustration, it is to be understood that such detail is solely for that purpose and that variations can be made therein by those of ordinary skill in the art without departing from the spirit and scope of the invention as defined by the following claims including all equivalents thereof.

What is claimed is:

1. A body harness comprising: a pair of shoulder straps; a pair of leg straps and a back pad; wherein each shoulder strap passes through the back pad and is connected to one of the leg straps: and wherein at least one of the straps utilizes a niece of curved webbing that has been preformed into a curved shape before being worn.

2. The body harness of claim 1 wherein the back pad is generally X-shaped with the upper arms of the X being longer than the lower arms of the X.

3. The body harness of claim 2 wherein the shoulder straps passes through the back pad in a crossed fashion and passes through a front pad in a crossed fashion.

4. The body harness of claim 2 wherein each end of the leg strap is connected to a leg buckle.

5. The body harness of claim 2 wherein the back pad has a plurality of openings therein with at least one opening in each arm of the X.

6. The body harness of claim 5 wherein the openings in the upper arms of the back pad are slightly offset upwardly and outwardly from the centerlines of the back pad relative to the openings in the bottom arms.

7. The body harness of claim 6 wherein the plurality of openings are slots for the shoulder straps with two slots in each arm of the X.

8. The body harness of claim 1 wherein the back pad is generally Y-shaped.

9. The body harness of claim 1 wherein the shoulder straps comprise curved webbing.

10. The body harness of claim 1 wherein the leg straps comprise curved webbing.

11. The body harness of claim 1 further comprising a subpelvic strap of curved webbing.

12. A body harness comprising: a pair of shoulder straps made from curved webbing that has been preformed into a curved share before being worn; a pair of leg straps; and a back pad; wherein each shoulder strap passes through the back pad, and is connected to one of the leg straps.

13. The body harness of claim 12 wherein the curved webbing comprises one of the following materials: polyester, nylon and Kevlar.

14. The body harness of claim 12 wherein the curved webbing has a width of 1.75–2.0 inches.

15. The body harness of claim 12 wherein the curved webbing has a radius of curvature of two inches.

16. The body harness of claim 15 wherein the radius of curvature occurs at an angle of 24°.

17. The body harness of claim 12 wherein the curved webbing is formed from straight webbing using a heatsetting process.

18. The body harness of claim 17 wherein the heatsetting process uses dry heat.

19. A body harness comprising: a pair of shoulder straps; a pair of leg straps and a back pad; wherein each shoulder strap passes through the back pad and is connected to one of the leg straps; and wherein the back pad is generally X-shaped with the upper arms of the X being longer than the lower arms of the X, there being a plurality of openings in the back pad with at least one opening in each arm of the X, and the openings in the upper arms of the back pad are slightly offset upwardly and outwardly from the centerlines of the back pad relative to the openings in the bottom arms.

20. The body harness of claim 19 wherein the plurality of openings are slots for the shoulder straps with two slots in each arm of the X.

* * * * *